United States Patent [19]

Sjöstrand

[11] 4,037,504

[45] July 26, 1977

[54] DEVICE IN A PIANO MECHANISM

[76] Inventor: Gunnar Sjöstrand, Onhult Box 268 A, Atvidaberg, Sweden

[21] Appl. No.: 618,360

[22] Filed: Oct. 1, 1975

[30] Foreign Application Priority Data

Oct. 14, 1974 Sweden ..... 7412876

[51] Int. Cl.[2] ..... G10C 3/18; G10C 3/00

[52] U.S. Cl. ..... 84/255; 84/217

[58] Field of Search ..... 84/255, 217, 241, 243

[56] References Cited

U.S. PATENT DOCUMENTS

| | | | |
|---|---|---|---|
| 364,399 | 6/1887 | Dopp | 84/217 |
| 2,866,371 | 12/1958 | Stein | 84/255 |
| 2,905,041 | 9/1959 | Machalek | 84/255 |
| 3,208,326 | 9/1965 | Bendall | 84/255 |

*Primary Examiner*—Stephen J. Tomsky

*Attorney, Agent, or Firm*—George H. Mitchell, Jr.

[57] ABSTRACT

A piano mechanism for correlating the movement of the damper with the movement of the hammer consists of a hammer lifter connected between the hammer arm and the damper arm at a location on the side of its axis opposite to that of the damper itself.

3 Claims, 1 Drawing Figure

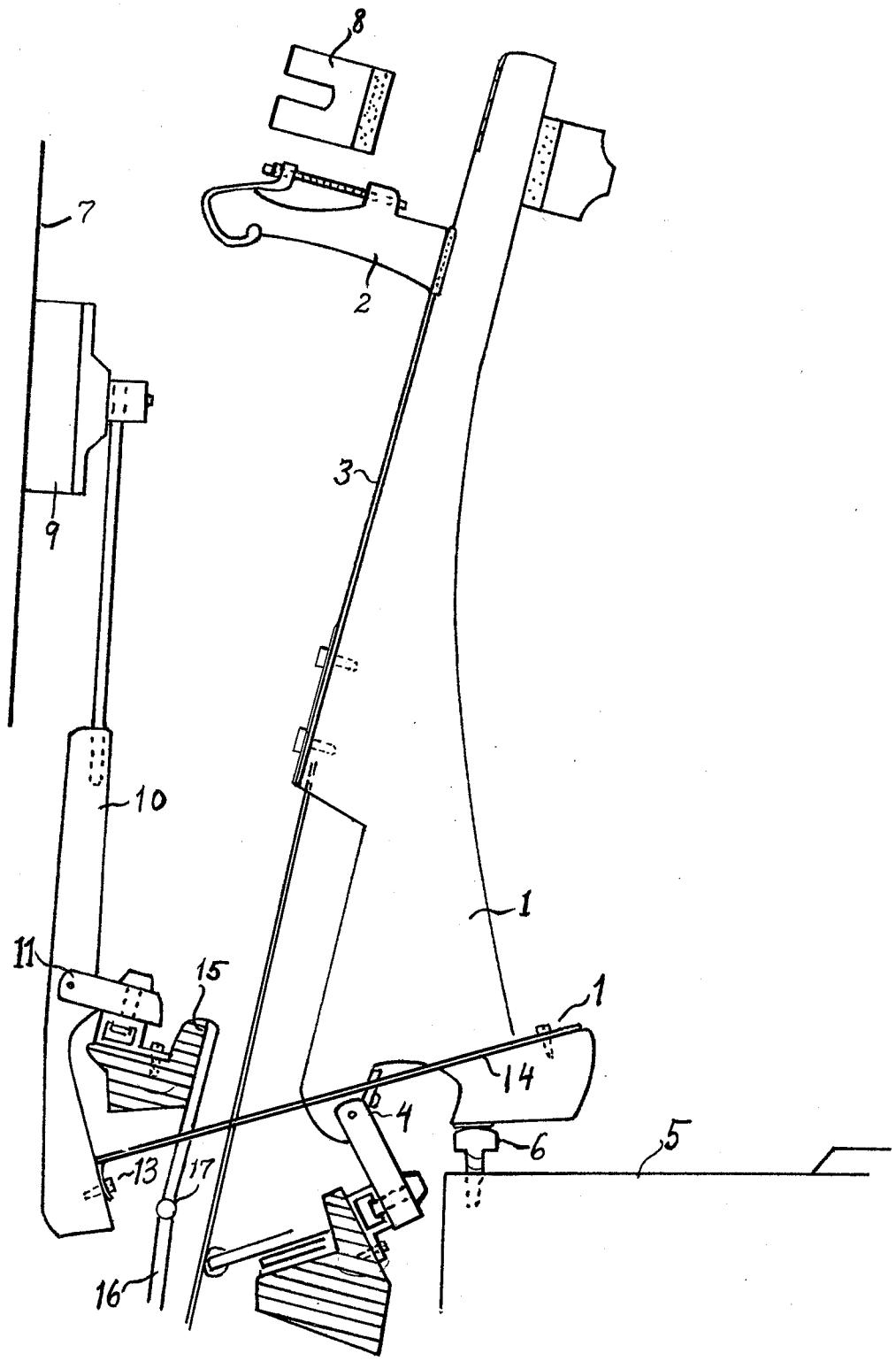
8
7
2
3
9
10
1
11
15
1
14
4
6
5
13
17
16

DEVICE IN A PIANO MECHANISM

The present invention refers to a device in a piano mechanism for controlling the movement of a damper and for relating this movement to the movement of a hammer affecting a string.

In pianos the damping of strings has constituted a substantial problem. When the hammer arm and the hammer attached to it is struck the strings must be released from the dampers in order to generate a tone. When a damper is to release a string, usually a so-called damper-spoon is pressed against the damper arm to which the damper is attached. This involves friction which frequently gives rise to disturbing noise. Often one also obtains a wearing which affects the distances between the different components of the mechanics and thus makes adjustments on the mechanism necessary.

According to the present invention the friction against the damper arm is completely eliminated. The characteristics of the invention will appear from the claims.

The invention will now be described in detail reference being made to the enclosed drawing which shows a string with its damper and hammer.

In the drawing reference 1 denotes a hammer arm on which a hammer 2 is attached by means of a plate spring 3. The hammer arm is journalled on an axis 4 and is affected by the key 5 via the screw 6. The hammer 2 will then strike the string 7, whereas the movement of the hammer arm is terminated by the stop 8. When the string is at rest a damper 9 attached to a damper arm 10 and journalled on an axis 11 affects the string. The damper arm 10 is linked to the hammer arm 1 by means of a damper lifter 14 which runs between a point 12 on the hammer arm close to its end remote to the hammer 2 and a point 13 on the damper arm located at the opposite side of the axis 11. The damper lifter 14 is preferably made from a resilient material and could for instance be made of a piano string. Reference 15 denotes a damper frame to which all the dampers of the instrument are attached and which is affected by the arm 16 journalled on the axis 17 implying that a turning of the arm 16 around the axis 17 implies a release of all the dampers from the strings.

When the hammer arm 1 is affected and the hammer 2 strikes the string 7 this movement will be transferred via the damper lifter 14 so as to release the string 7 from the damper 9.

Experiments have furthermore proved that the device according to the invention substantially reduces the tendency of a recoil of the hammer 2, which after it has struck the string is forced back towards the hammer arm by means of the spring 3. The hammer will thereby have a tendency to bounce against the hammer arm which bouncing is damped by the damper lifter 14 according to the invention.

I claim:

1. In piano mechanism for controlling the movement of a damper in coordination with the movement of a hammer, said damper being mounted on an elongated damper arm which is journalled on an axis, the improvement which comprises an elongated hammer arm mounted for movement toward and away from a piano string, and an elongated damper lifter means firmly connected to the hammer arm close to the end remote from the hammer and to the damper arm on the opposite side of said axis with respect to the damper, said damper lifter means being longitudinally unyielding in both directions whereby said damper arm is positively moved away from and toward said string in response to movements of the hammer arm in the respective opposite directions.

2. Device according to claim 1, characterized in that said damper lifter means is made of resilient material.

3. Device according to claim 2, characterized in that said damper lifter means comprises a length of piano string wire, the extremities thereof being fixed respectively to said damper arm and hammer arm.

* * * * *